US005372529A

United States Patent [19]

Binversie et al.

[11] Patent Number: 5,372,529

[45] Date of Patent: Dec. 13, 1994

[54] TRIM ASSEMBLY

[76] Inventors: Gregory J. Binversie, 309 Behm Dr., Grayslake, Ill. 60030; Joseph E. Capodarco, 7541 24th Ave., Kenosha, Wis. 53141

[21] Appl. No.: 46,492

[22] Filed: Apr. 9, 1993

Related U.S. Application Data

[63] Continuation of Ser. No. 675,327, Mar. 26, 1991, abandoned.

[51] Int. Cl.[5] ..... B63H 21/26

[52] U.S. Cl. ..... 440/61; 92/169.1

[58] Field of Search ..... 440/61; 114/150; 188/322.16; 254/93 R; 92/169.1, 109; 212/162, 163, 164

[56] References Cited

U.S. PATENT DOCUMENTS

| | | | |
|---|---|---|---|
| 2,615,379 | 10/1952 | De Groff | 95/54 |
| 3,608,438 | 9/1971 | Thomas et al. | 92/163 |
| 3,856,152 | 12/1974 | Parrett et al. | 212/163 |
| 4,391,592 | 7/1983 | Hundertmark | 440/61 |
| 4,410,193 | 10/1983 | Howard | 114/150 |
| 4,457,725 | 7/1984 | Kern et al. | 440/61 |
| 4,605,377 | 8/1986 | Wenstadt | 440/61 |
| 4,944,705 | 7/1990 | Kashima et al. | 440/61 |

FOREIGN PATENT DOCUMENTS

| | | | |
|---|---|---|---|
| 1206366 | 2/1960 | France . | |
| 1594768 | 7/1970 | France . | |
| 2615914 | 12/1988 | France . | |
| 1128624 | 4/1962 | Germany | 254/93 R |
| 2005472 | 8/1970 | Germany . | |
| 2156623 | 5/1973 | Germany . | |
| 899874 | 6/1962 | United Kingdom | 254/93 R |

*Primary Examiner*—Michael S. Huppert
*Assistant Examiner*—Thomas J. Brahan

[57] ABSTRACT

A marine propulsion device comprising a transom bracket adapted to be mounted on a boat transom, a swivel bracket supported on the transom bracket for pivotal movement about a generally horizontal tilt axis, a propulsion unit mounted on the swivel bracket for pivotal movement relative thereto about a generally vertical steering axis, a cylinder which is mounted on one of the swivel bracket and the transom bracket and which has a tapered inner surface defining an open end, a piston slideably housed by the cylinder, a rod having a first end connected to the piston and a second end extending from the open end of the cylinder, a mechanism for transmitting thrust forces from the other of the transom bracket the swivel bracket to the second end of the rod, and an end cap surrounding the rod and having a tapered outer surface engaged with the tapered inner surface of the cylinder.

2 Claims, 1 Drawing Sheet

TRIM ASSEMBLY

This is a continuation of Ser. No. 675,327 filed Mar. 26, 1991, now abandoned.

BACKGROUND OF THE INVENTION

1. Technical Field

The invention relates generally to marine propulsion devices such as outboard motors and stern drive units. More particularly, the invention relates to constructions of trim cylinder/piston assemblies for marine propulsion devices.

2. Reference to Prior Art

It is generally known to pivotally connect a swivel bracket to a transom bracket for pivotal movement relative thereto about a horizontal tilt axis. It is also known to provide a trim cylinder/piston assembly which is supported by the transom bracket and which includes a rearwardly extending trim piston rod having an outer end engageable with the swivel bracket to rotate the swivel bracket about the tilt axis.

FIG. 4 in the drawings illustrates a portion of a prior art construction of a hydraulic trim cylinder/piston assembly. The prior art construction of the trim cylinder/piston assembly includes a trim cylinder A having an upper portion defining an interiorly threaded open end B. The cylinder A also includes a step-like interior surface C formed by a pair of generally annular, axially facing shoulders D, E and inner and outer coaxial cylindrical surfaces F, G located in alternating relation with the annular shoulders D, E.

The prior art trim cylinder/piston assembly also includes an end cap H having a generally cylindrical head I including an annular undersurface J which engages annular shoulder D and a peripheral surface K which is in opposed facing relation to the outer cylindrical surface F. The end cap H also includes a threaded portion L screwed into threaded engagement with the open end B of the cylinder C. The end cap H also has extending therethrough a bore M which surrounds the piston rod N.

During operation of the marine propulsion unit, the piston rod N can subject the end cap H to radial loading. The end cap H can become loosened and unseat itself by such radial loading because of the clearance between peripheral surface K and the cylindrical surface F of the cylinder A. The undersurface J of the end cap H which engages annular surface D provides a friction fit between the end cap H and the cylinder A. During operation of the propulsion unit, however, such radial loading can cause vibration of the end cap H and relative movement between the engaged surfaces D, J. Such loosening of the end cap H can compromise the integrity of the sealed hydraulic trim cylinder/piston assembly and can lead to corrosion or failure of the hydraulic trim cylinder/piston assembly.

Manufacture of the prior art construction to close tolerances can reduce the detrimental effects of such vibration, but such precise manufacture is difficult and expensive due to the critical relationship between the threaded engagement of the end cap H and the cylinder A and the clearance between the end cap's peripheral surface K and the shoulder F of cylinder A. Moreover, the manufacture of trim cylinder A to close tolerances does not eliminate occurence of loosening of the end cap H. Prior efforts to prevent loosening of the end cap H of the prior art construction have also included over-tightening of the end cap H and the trim cylinder A. Such over-tightening is undesireable from a maintanence standpoint and which also is only marginally effective. Attention is directed to the following U.S. Patents: U.S. Pat. No. 2,615,379 which issued to De Groff on Oct. 28, 1952; and U.S. Pat. No. 3,608,438 which issued to Thomas et al. on Sep. 28, 1971.

SUMMARY OF THE INVENTION

Accordingly, it is an object of the invention to provide a trim cylinder assembly including a superior design so that the trim cylinder and end cap remain in engagement during operation of the marine propulsion unit yet are relatively economical to manufacture.

The invention provides a marine propulsion device comprising a transom bracket adapted to be mounted on a boat transom, a swivel bracket supported on the transom bracket for pivotal movement about a generally horizontal tilt axis, a propulsion unit mounted on the swivel bracket for pivotal movement relative thereto about a generally vertical steering axis, a cylinder which is mounted on one of the swivel bracket and the transom bracket and which has a tapered inner surface defining an open end, a piston slideably housed by the cylinder, a rod having a first end connected to the piston and a second end extending from the open end of the cylinder, means for transmitting thrust forces from the other of the transom bracket the swivel bracket to the second end of the rod, and an end cap surrounding the rod and having a tapered outer surface engaged with the tapered inner surface of the cylinder.

The invention also provides a marine propulsion device comprising a transom bracket adapted to be mounted on a boat transom, a swivel bracket supported by the transom bracket for pivotal movement about a generally horizontally extending pivot axis, and a trim assembly including a cylinder which is supported by one of the swivel bracket and the transom bracket and which has an open end, a piston slideably housed by the cylinder, a trim rod having one end connected to the piston and having an opposite end extending from the open end of the cylinder, means for transferring thrust from the other of the swivel bracket and the transom bracket to the trim rod, an end cap engaging the open end of the cylinder to form a seal and having therethrough a bore receiving the trim rod, and means for preventing relative radial movement between the end cap and the cylinder caused by radial loading on the trim rod.

The invention also provides a marine propulsion device comprising a transom bracket adapted to be mounted on a boat transom, a swivel bracket supported by the transom bracket for pivotal movement about a generally horizontally extending pivot axis, and a trim assembly including a cylinder supported by one of the swivel bracket and the transom bracket and having an open end, a closed end and a longitudinal axis extending between the open and closed ends, a portion defining a generally annular, frustoconical surface adjacent the open end of the cylinder and being centered on the cylinder axis, an internally threaded portion located between the open and closed ends, and the cylinder having a first annular surface located between the open end and the internally threaded portion, extending inwardly of the cylinder perpendicularly to the cylinder axis and facing the open end, a piston slideably housed by the cylinder, a trim rod extending along the axis of the cylinder and having one end connected to the piston and having an opposite end extending from the open end of the cylinder, means for transferring thrust from the other of the swivel bracket and the transom bracket to the trim rod, an end cap engaging the open end of the cylinder to form a seal, the end cap having therethrough a bore receiving the trim rod, a frustoconical peripheral surface engageable with the frustoconical surface of the cylinder, an externally threaded portion adapted to selectively engage the internally threaded portion of the cylinder and the end cap having a second annular surface extending perpendicularly to the axis and facing the first annular surface, and a compressible annular seal engaged between the first and second annular surfaces and the first and second annular surfaces compressing the seal when the end cap and the cylinder are threadedly engaged.

One of the principal features of the invention is the provision of a trim cylinder having a tapered peripheral surface which is sealingly engaged by a frustoconical end cap. The end cap can be wedged into sealed engagement with the cylinder so that the end cap need not be made to close tolerances in order to sealingly engage the trim cylinder.

Another principal feature of the invention is the provision of a trim cylinder and end cap which have sealingly engaged surfaces extending at an oblique angle relative to the axis of the cylinder. The angled relationship of the engaged surfaces of the cylinder and end cap with respect to the axis of the cylinder prevents radial relative movement between the engaged surfaces caused by radial loading on the end cap from the trim rod that extends through the end cap.

Other features and advantages of the invention will become apparent to those skilled in the art upon review of the following detailed description, claims, and drawings.

Figure 1:
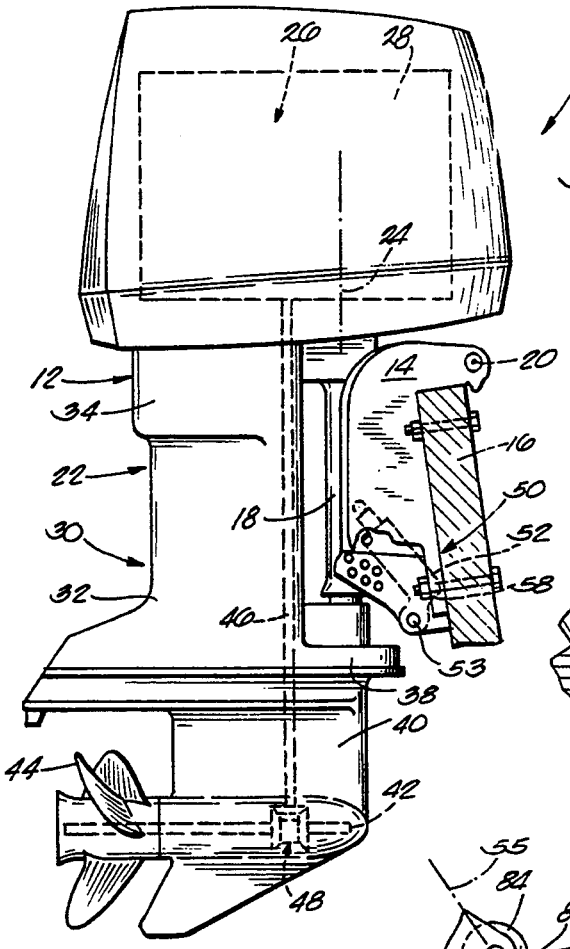
FIG. 1 is a side elevational view of a marine propulsion device incorporating various features of the invention.
Figure 4:
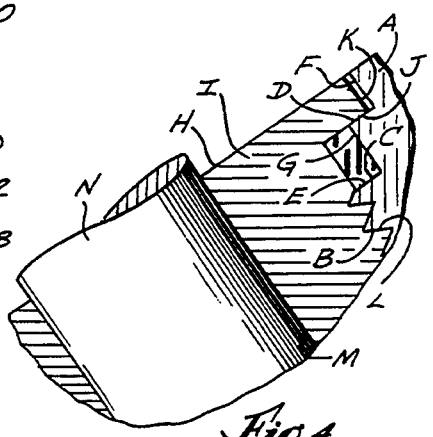
FIG. 4 is a view similar to FIG. 3 and illustrates a prior art construction of a trim assembly.

Before one embodiment of the invention is explained in detail, it is to be understood that the invention is not limited in its application to the details of construction and the arrangements of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DETAILED DESCRIPTION OF THE PREFERRED EMBODIMENT

FIG. 1 illustrates a marine propulsion device 10 which is in the form of an outboard motor 12 and which embodies various features of the invention, although various features of the invention can also be applied to stern drive units. The outboard motor 12 includes a transom bracket 14 fixedly mounted to a boat transom 16, and a swivel bracket 18 which is pivotally mounted on the transom bracket 14 for vertical tilting movement about a generally horizontally extending tilt axis 20.

The outboard motor 12 also includes a propulsion unit 22 which is connected to the swivel bracket 18 for common movement therewith about the tilt axis 20 and for pivotal movement relative to the swivel bracket 18 about a generally vertical steering axis 24. The propulsion unit 22 comprises a power head 26, which includes an internal combustion engine 28, and a lower unit 30 including a drive shaft housing 32 which, at its upper end 34, is fixedly connected to the power head 26 and which, at its lower end 38, is fixedly connected to a gear case 40 rotatably supporting a propeller shaft 42 carrying a propeller 44. The internal combustion engine 28 drives the propeller shaft 42 through a vertically extending drive shaft 46 located within the drive shaft housing 32 and through a reversing transmission 48 located in the gearcase 40 and connecting the drive shaft 46 to the propeller shaft 42.

While various features of the outboard motor 12 have been described, U.S. patent application Ser. No. 523,321 filed on May 14, 1990 (Attorney Docket No. 72012/0460) discloses a suitable construction for the outboard motor 12 and is incorporated herein by reference.

Hydraulic means 50 are provided for pivoting the swivel bracket 18 and the connected propulsion unit 22 about the horizontal tilt axis 20 and relative to the transom bracket 14. While other constructions can be employed, in the illustrated embodiment, the hydraulic means 50 includes a hydraulically actuated trim assembly 52. More specifically, the hydraulic trim assembly 52 includes (see FIG. 2) a hydraulic trim cylinder/piston assembly which is pivotally supported by a horizontal rod 53 fixed to the lower portion of the transom bracket 14 and which is engageable with the swivel bracket 18 to rotate the swivel bracket 18 about the generally horizontal tilt axis 20. The trim assembly 52 includes a trim cylinder 54 having a longitudinally extending axis 55 and a wall 56 which defines a blind or closed lower end 58 which, as shown in FIG. 1, is pivotally mounted on rod 53. The cylinder 54 also includes (see FIGS. 2 and 3), for reasons discussed below, an upper portion 60 which defines an open, upper end 62. The upper portion 60 of the cylinder 54 includes (see FIG. 3) an inwardly tapered, frustoconical, generally annular surface 64 which is located adjacent the open end 62, which is substantially centered on the axis 55 and which comprises diametrically opposed, tapered surfaces 65. The cylinder wall 56 also includes a first cylindrical, inwardly facing surface 66 which is centered on the axis 55 and which extends from the lower, inner edge of the frustoconical surface 64 toward the lower end 58 of the cylinder 54. A second annular surface 67 extends generally perpendicular to the axis 55 inwardly of the cylindrical surface 66 and faces the open end 62 of the cylinder 54. The upper portion 60 of the cylinder 54 also includes a second generally cylindrical, inwardly facing surface 68 which extends generally axially toward the lower end 58 of the cylinder 54 from the annular surface 67 and which is threaded.

The trim assembly 52 also includes (FIG. 2) a trim piston rod 70 which is housed by the trim cylinder 54 and which extends generally along the axis 55. The rod 70 has a first or inner end 72 which supports a piston 74 slidingly engaged with the cylinder wall 56. The piston 74 divides the cylinder 54 into upper and lower chambers 75 and 76. The rod 70 also has a second, outer end 77 extending from the open end 62 of the cylinder 54. The outer end 77 of the trim rod 70 is provided with an enlarged head 80 having an outer abutment surface 82 which extends in a plane generally perpendicular to the axis 55. The enlarged head 80 engages a thrust roller 84 which is carried by the swivel bracket 18 for pivotal movement relative thereto about a generally horizontally extending axis. During forward propulsion, the head 80 of the trim rod 70 engages the thrust roller 84 and transmits thrust therebetween. Thus, the trim assembly 52 constitutes means for transferring thrust forces between the swivel bracket 18 and the transom bracket 14 during forward propulsion.

The hydraulic means 50 also includes means (not shown) for supplying hydraulic fluid to the cylinder chambers 75 and 76 for selectively moving the piston 74 along the axis 55. The means for supplying hydraulic fluid to the cylinder chambers 75, 76 is conventional and known in the art.

Figure 2:
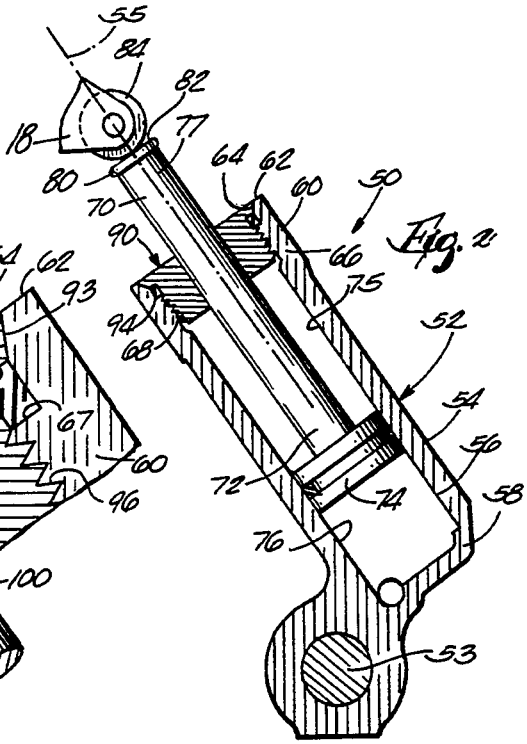
FIG. 2 is an enlarged, fragmentary view of the trim assembly incorporated by the device shown in FIG. 1.
Figure 3:
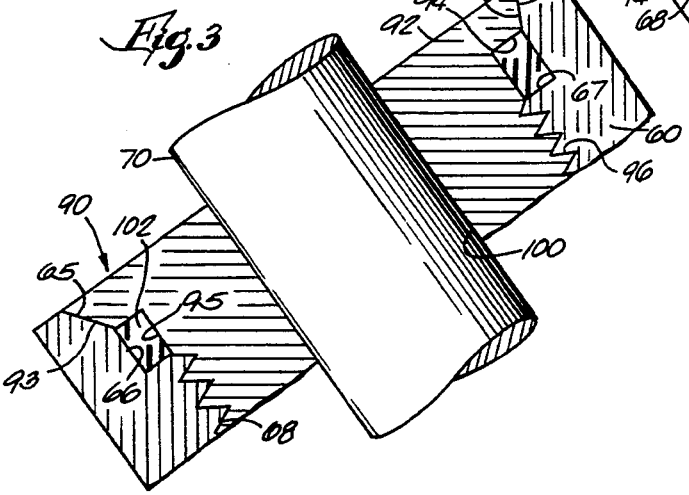
FIG. 3 is an enlarged cross-sectional view of the portion illustrated in FIG. 2.

The outboard motor 12 also includes means 90 for transmitting radial loads from the trim rod 70 to the cylinder 54. While various suitable constructions can be employed, in the illustrated embodiment, the means 90 for transmitting radial loads from the trim rod 70 to the cylinder 54 includes (FIG. 3) a generally cylindrical end cap 92 engaged with the trim cylinder 54. The end cap 92 includes a generally annular, frustoconical outer surface 93 which tapers radially inwardly toward the lower end 58 of the cylinder 54 and which is sealingly engaged with the frustoconical, generally annular surface 64 on the open end 62 of the cylinder 54. The end cap 92 also includes a generally annular surface 94 which extends radially inwardly from the lower, inner edge of the frustoconical surface 93 and which faces, and is spaced from, the annular surface 67 on the upper portion 60 of the cylinder 54. As shown in FIG. 2, the annular surface 94 faces the lower end 58 of the cylinder 54 and the piston 74. The end cap 92 also includes (see FIG. 3) a generally axially extending cylindrical surface 95 which faces, and is spaced from, the inwardly facing cylindrical surface 66 of the upper portion 60 of the cylinder 54. The cylindrical surface 95 extends axially toward the lower end 58 of the cylinder 54 beyond the annular surface 67 of the cylinder 54 and includes an externally threaded portion 96 which is engaged with the threaded surface 68. The end cap 92 also has therethrough a bore 100 through which the trim rod 70 extends so that the end cap 92 sealingly and slideably engages the trim rod 70 in a conventional manner.

The end cap 92 is moved into sealing engagement with the trim cylinder 54 by placing the trim rod 70 through the bore 100 and by threading the externally threaded portion 96 of the end cap 92 into engagement with the internally threaded portion 68 of the cylinder 54. As the end cap 92 is rotated and advanced into engagement with the upper portion 60 of the cylinder 54, the frustoconical peripheral surface 93 of the end cap 92 moves into sealing engagement with the frustoconical surface 64 of the cylinder 54. Once the surfaces 64 and 93 are engaged, the end cap 92 can be tightened or wedged into sealed engagement with the cylinder wall 56 by further rotating the end cap 92. The threaded engagement between the portions 68, 96 maintains the hydraulic charge inside the cylinder 54. The threaded portions 68, 96 are protected by the sealed fit of the end cap 92 and cylinder 54 (the surfaces 64 and 93) from corrosion which can be caused by sea water and the like. The arrangement of engaged surfaces which extend at an oblique angle to the axis 55 and which can be moved into sealingly engagement by a wedging action of the frustoconical surface 93 against the opposed tapered surfaces 65 provides advantage in that the end cap 92 and the open end 62 of the cylinder 54 need not be machined to close, matching tolerances. Rather, the end cap 92 can simply be threaded into the cylinder 54 until the surfaces 65 and 93 are sealingly engaged.

The trim assembly 52 also includes (FIG. 3) an annular elastomeric, compressible member or O-ring or seal 102 which surrounds the cylindrical surface 95 of the end cap 92 and which is located axially between, and is compressably engaged by, the opposed facing annular surfaces 67 and 94. The provision of an O-ring 102 enhances the integrity of the sealed connection between the end cap 92 and the cylinder 54 and further protects threaded portions 68 and 96. Thus, the trim assembly 52 provides means for selectively connecting the end cap 92 and the trim cylinder 54, and includes means for sealing the open end 62 of the cylinder 54 when the end cap 92 and the cylinder 54 are threadedly engaged.

Various features of the invention are set forth in the following claims.

I claim:

1. A marine propulsion device comprising a transom bracket adapted to be mounted on a boat transom, a swivel bracket supported on said transom bracket for pivotal movement about a generally horizontal tilt axis, a propulsion unit which is mounted on said swivel bracket for pivotal movement relative thereto about a generally vertical steering axis and which includes a propeller shaft, a cylinder which is mounted on one of said swivel bracket and said transom bracket and which has an axis, an open end, and a portion adjacent said open end including an axially outwardly divergent frustroconical surface concentric with said axis and having an axially located end, an internally threaded subportion located concentrically with said axis and having an axially located end, and an annular surface located adjacent said axially located end of one of said internally threaded subportion and said frustroconical surface and extending perpendicularly to and concentrically with said axis, a piston slideably housed by said cylinder, a rod having a first end connected to said piston and a second end extending from said open end of said cylinder, means for transmitting thrust forces from the other of said transom bracket and said swivel bracket to said second end of said rod, and an end cap surrounding said rod and having an axially outwardly divergent frustroconical surface concentric with said axis and engaging said frustroconical surface of said cylinder portion, an externally threaded subportion located concentrically with said axis and engaging said internally threaded subportion of said cylinder portion, and an annular surface extending perpendicularly to and concentrically with said axis and in spaced parallel relation to said annular surface of said cylinder portion, and a sealing member located between and in engagement with said annular surfaces of said cylinder portion and said end cap.

2. A marine propulsion device comprising a transom bracket adapted to be mounted on a boat transom, a swivel bracket supported by said transom bracket for pivotal movement about a generally horizontally extending pivot axis, and a trim assembly including a cylinder supported by one of said swivel bracket and said transom bracket and having an open end, a closed end, a longitudinal axis extending between said open and closed ends, a generally annular, frustoconical surface extending from adjacent said open end of said cylinder and being centered on said cylinder axis, an annular surface located axially inwardly of said frustoconical surface and extending perpendicularly to said cylinder axis and, an internally threaded portion located axially inwardly of said annular surface, a piston slideably housed by said cylinder, a trim rod extending along said cylinder axis and having one end connected to said piston, and an opposite end extending from said open end of said cylinder, means for transferring thrust from said other of said swivel bracket and said transom bracket to said trim rod, an end cap engaging said open end of said cylinder and having therethrough a bore receiving said trim rod, an axially outer end, an axially inner end, a frustoconical peripheral surface adjacent said outer end and engaging said frustoconical surface of said cylinder, an annular surface located axially inwardly of and adjacent said end cap frustroconical surface, extending perpendicularly to said axis and facing said cylinder annular surface and, an externally threaded portion located axially inwardly of said end cad annular surface and engaging said internally threaded portion of said cylinder, and a compressible annular seal sealingly engaged between said annular surfaces of said cylinder and said end cap.

* * * * *

UNITED STATES PATENT AND TRADEMARK OFFICE

CERTIFICATE OF CORRECTION

PATENT NO. : 5,372,529

DATED : December 13, 1994

INVENTOR(S) : Binversie, et al.

It is certified that error appears in the above—identified patent and that said Letters Patent is hereby corrected as shown below:

On the cover page, add the following:

Assignee: OUTBOARD MARINE CORPORATION
Waukegan, Illinois

Signed and Sealed this

Twenty-fifth Day of July, 1995

*Attest:*

Bruce Lehman

BRUCE LEHMAN

*Attesting Officer*

*Commissioner of Patents and Trademarks*